US008992827B2

(12) United States Patent
Birol

(10) Patent No.: US 8,992,827 B2
(45) Date of Patent: Mar. 31, 2015

(54) PROCESS FOR PRODUCING IMPROVED GRAIN REFINING ALUMINUM—TITANIUM—BORON MASTER ALLOYS FOR ALUMINUM FOUNDRY ALLOYS

(75) Inventor: Yucel Birol, Gebze (TR)

(73) Assignee: Tubitak, Ankara (TR)

( * ) Notice: Subject to any disclaimer, the term of this patent is extended or adjusted under 35 U.S.C. 154(b) by 799 days.

(21) Appl. No.: 13/203,538

(22) PCT Filed: Feb. 27, 2009

(86) PCT No.: PCT/IB2009/050808

§ 371 (c)(1),
(2), (4) Date: Nov. 23, 2011

(87) PCT Pub. No.: WO2010/097658

PCT Pub. Date: Sep. 2, 2010

(65) Prior Publication Data

US 2012/0251376 A1 Oct. 4, 2012

(51) Int. Cl.

| | |
|---|---|
| ***C22C 1/05*** | (2006.01) |
| ***C22C 1/04*** | (2006.01) |
| ***C22C 1/03*** | (2006.01) |

(52) U.S. Cl.

CPC ..... *C22C 1/0416* (2013.01); *C22C 1/03* (2013.01)

USPC ..... 419/12; 419/31; 419/33; 419/34; 148/513

(58) Field of Classification Search

None

See application file for complete search history.

(56) References Cited

U.S. PATENT DOCUMENTS

| | | | | |
|---|---|---|---|---|
| 5,100,618 | A * | 3/1992 | Dewing et al. | 420/528 |
| 5,415,708 | A | 5/1995 | Young | |
| 5,484,493 | A * | 1/1996 | Young et al. | 148/437 |
| 7,988,764 | B2 * | 8/2011 | Birol et al. | 75/685 |

FOREIGN PATENT DOCUMENTS

| | | |
|---|---|---|
| EP | 1029934 | 8/2000 |
| EP | 1134299 | 9/2001 |
| GB | 2299099 | 9/1996 |
| WO | WO 03/033750 | 4/2003 |

* cited by examiner

*Primary Examiner* — Jessee Roe

*Assistant Examiner* — Christopher Kessler

(74) *Attorney, Agent, or Firm* — Epstein Drangel LLP; Robert L. Epstein

(57) ABSTRACT

A process is provided for producing aluminum-titanium-boron grain refining master alloys containing soluble titanium aluminide and insoluble aluminum boride particles, the process comprising mixing aluminum-boron alloy powder and $K_2TiF_6$ salt to obtain a blended mixture, heat treating the mixed powder blend thus obtained in an inert gas furnace just below the melting point of aluminum, at approximately 650 degrees Celcius sufficiently long and compacting the heated powder blend in the form of tablets. The cast grain size of an aluminum- 7 wt % silicon foundry alloy after inoculation with this master alloy at an addition level of 0.02% Ti was less than 200 microns for contact times of upto 15 minutes.

5 Claims, 2 Drawing Sheets

PROCESS FOR PRODUCING IMPROVED GRAIN REFINING ALUMINUM—TITANIUM—BORON MASTER ALLOYS FOR ALUMINUM FOUNDRY ALLOYS

TECHNICAL FIELD

The present invention relates to a process for producing aluminum-titanium-boron master alloy tablets for use in the promotion of uniformly distributed, small, equiaxed grains in aluminum foundry alloys.

The grain size in aluminum castings, ingots, slabs, strips is an important industrial consideration and it is almost always advantageous to provide a high degree of grain refinement. It has thus become a common practice in recent years to add master alloys to molten aluminum in order to achieve fine, equiaxed grains after solidification which otherwise tend to be coarse and columnar. A fine, equiaxed grain structure imparts to a casting, high toughness, high yield strength, excellent formability, good surface finish and improved machinability. Furthermore, a sound grain-refining practice avoids hot tearing and porosity which can result from the occurrence of large columnar grains, allows a marked increase in casting speed and improves the homogeneity of the cast structure by refining the distribution of secondary phases. The use of grain-refining alloys in casting of ingots, billets and strip, has thus become a standard practice in aluminum foundries worldwide.

BACKGROUND ART

It is well known that addition of titanium to aluminum alloys causes grain refinement of the resulting castings through nucleation of alpha aluminum by the primary $Al_3Ti$ phase which forms via the peritectic reaction. Additions of boron were shown to remarkably improve grain refinement of aluminum by titanium at hypoperitectic concentrations. A. Cibula, *J. Inst. Met.,* 76 (1949-1950) 321-360. As a result, Al—Ti—B master alloys emerged as potential grain refiners for aluminum alloys. At present, there is a variety of commercial grain refiners of this type. Examples of these alloys are disclosed in U.S. Pat. Nos. 3,857,705, 4,298,408, 4,612,073 and 4,873,054. Various methods for the production of Al—Ti—B grain refiner alloys have been described in U.S. Pat. Nos. 6,228,185, 5,415,708, 5,484,493, 3,961,995, 3,785, 807, 5,104,616, GB-A-2,257,985, GB-A-2,259,308 and GB-A-2,259,309 as well as in numerous papers. D. G. McCartney, *Int. Mater. Rev.,* 34 (1989) 247. B. S. Murty et al., *J. Mater. Process. Tecnol.,* 89-90 (1999) 152-158. B. S. Murty et al., *Int. Mater. Rev.,* 47 (2002) 3-29. M. S. Lee and B. S. Terry, *Mater Sci. Technol.,* 7 (1991) 608-612; M. J. Jackson and I. D. Graham, *J. Mater. Sci Lett.,* 13 (1994) 754-756; M. S. Lee, B. S. Terry and P. Grieveson, *Metall. Trans. B.,* 24B (1993) 955-961; Q. Zhuxian et al., *Aluminium,* 64 (1988) 1254-1257; I. G. Davies et al., *Metall. Trans.,* 1 (1970) 275-280; I. Maxwell and A. Hellawell, *Acta Metall.,* 23 (1975) 895-899, K. A. Q. O'Reilly et al., *Scr. Metall. Mater.,* 28 (1993) 173-177; T. S. Krishnan et al., *J. Alloy. Compd.,* 269 (1998) 138-140; M. G. Chu, *Mater. Sci. Eng., A*179-180 (1994) 669-675. C. S. Sivaramakrishnan and R. Kumar, *Light Metal Age,* 10 (1987) 30-34. C. D. Mayes and D. G. McCartney, *Mater. Sci. Tech.,* 9 (1993) 97-103. M. M. Guzowski, et al., *Metall. Trans.,* 18A (1987) 603-619.

The present invention describes a process to synthesize Al—Ti—B alloys with the insoluble $AlB_2$ and the soluble $Al_3Ti$ particles to maximize the grain refining efficiency with aluminium foundry alloys. It relies on a solid-state reaction between aluminium and $K_2TiF_6$ to generate $Al_3Ti$ particles in a mixture which already has preformed $AlB_2$ particles. The more stable of the two potential borides, $TiB_2$, is inevitably favored when $KBF_4$ and $K_2TiF_6$ salts are added to molten aluminium. Even when the halide salts are added sequentially so as to form first $AlB_2$, one would expect $AlB_2$ to transform to $TiB_2$ as soon as $K_2TiF_6$ is added in the melt, according to, $3K_2TiF_6+3AlB_2+Al®3TiB_2+3KAlF_4+K_3AlF_6$, since $TiB_2$ is more stable than $AlB_2$. The process of the present invention not only avoids the $AlB_2$ to $TiB_2$ transformation, but also offers exceptional microstructural features. $Al_3Ti$ particles generated by a solid state reaction between $K_2TiF_6$ and aluminium are much smaller than those available in Al—Ti/Al—Ti—B master alloys prepared with prior art yielding a superior grain refining performance.

The present invention offers a process for the production of Al—Ti—B grain refiner master alloys, containing from 1 to 10% titanium, 0.2 to 3% boron and the balance essentially aluminum, wherein the resultant alloy contains $Al_3Ti$ particles having a diameter of less than 20 microns and a fine dispersion of $AlB_2$ particles. The process of the present invention also relies on the reaction of halide salts with aluminum to produce Al—Ti—B grain refiner master alloy, yet is different from the prior art as it is a powder metallurgy process and takes place in the solid state. The present invention yields smaller $Al_3Ti$ particles which ensure a fast grain refining response and $AlB_2$, instead of $TiB_2$ particles. The Al—Ti—B grain refiner alloys produced according to the present invention provided consistent and better overall grain refining performance with respect to those prepared with the prior art.

A sound process to produce a Al—Ti—B master alloys which ensure an adequate grain refining performance for aluminium foundry alloys is claimed to comprise the following steps: Mixing Al—B alloy powder and $K_2TiF_6$ salt thoroughly to obtain a blended mixture; heating the mixed powder blend thus obtained under flowing argon to slightly below the melting point of aluminium, i.e. 650 degrees Celcius, and holding it at this temperature sufficiently long, i.e. for ½ hours. Inoculation with the said alloys has produced a fine equiaxed grain structure across the entire section of the test sample which was more or less retained for 15 minutes after inoculation. Besides, the dendritic as-cast structure is improved into a more homogeneous one, dominated by equiaxed a —Al rosettes.

DISCLOSURE OF INVENTION

Technical Problem

The commercially available master alloys based on the Al—Ti—B system have either titanium or boron in excess of that amount required to form the $TiB_2$ compound. The majority of the commercial grain refiners fall in the former category. The microstructure of Al—Ti—B alloys with more Ti than that required to form $TiB_2$ typically comprises, in addition to the insoluble $TiB_2$, the soluble $Al_3Ti$ particles dispersed in an aluminium matrix. The former act as heterogeneous nucleation sites while $Al_3Ti$ particles readily dissolve in the melt and provide solute Ti, the pardoning of which between the solid and liquid phases during solidification, slows down the growth process.

The excess-Ti alloys, are known to perform adequately for wrought aluminium alloys. However, they suffer well known drawbacks in the case of foundry alloys with adverse effects on the as-cast structure and inferior properties in cast parts. S. A. Kori et al., *Mat. Sci. Eng.* A283 (2000) 94. Silicon forms silicides with Ti and thus severly impairs the potency of $TiB_2$ particles. The high content of Si is responsible for the poor response of foundry alloys to grain refinement by Al—Ti—B master alloys. G. K. Sigworth, M. M. Guzowski, *AFS. Trans.* 93 (1985) 907. J. A. Spittle, S. Sadli, *Mater. Sci. Tech.* 11 (1995) 533. T. Sritharan, H. Li, *J. Mater. Process Tech.* 63 (1997) 585. P. S. Mohanty, J. E. Gruzleski, *Acta Mater.* 44 (1996) 3749. P. S. Mohanty, F. H. Samuel, G. E. Gruzleski: *Metall. Trans. B.* 26 (1995) 103. $AlB_2$ particles, on the other hand, take advantage of high levels of Si which enhances their nucleation potential. The superior performance of Al-borides, which are not efficient in the absence of Si, is attributed to the dissolved Si in the foundry alloys. G. K. Sigworth, M. M. Guzowski, *AFS. Trans.* 93 (1985) 907.

Prior art provide Al—Ti—B alloys with either $Al_3Ti$ and $TiB_2$ particles as in the case of excess-Ti alloys or merely $(Al,Ti)B_2$ particles as in the case of excess-B alloys. It would be very attractive to produce Al—Ti—B alloys with $Al_3Ti$ and $AlB_2$, instead of $TiB_2$ particles to grain refine aluminium foundry alloys. While there are a number of excess-B ternary Al—Ti—B and binary Al—B alloys in the market developed specially for foundry alloys, these alloys predominantly contain $(Al,Ti)B_2$ or $AlB_2$ but no $Al_3Ti$ particles, and thus do not enjoy the growth restriction provided by solute Ti.

Technical Solution

The present invention describes a process to synthesize Al—Ti—B alloys with the insoluble $AlB_2$ and the soluble $Al_3Ti$ particles to maximize the grain refining efficiency with aluminium foundry alloys. It relies on a solid-state reaction between aluminium and $K_2TiF_6$ to generate $Al_3Ti$ particles in a mixture which already has preformed $AlB_2$ particles. The more stable of the two potential borides, $TiB_2$, is favoured when $KBF_4$ and $K_2TiF_6$ salts are added to molten aluminium. Even when the halide salts are added sequentially so as to form first $AlB_2$, one would expect $AlB_2$ to transform to $TiB_2$ as soon as $K_2TiF_6$ is added in the melt, according to, $3K_2TiF_6+3AlB_2+Al®3TiB_2+3KAlF_4+K_3AlF_6$, since $TiB_2$ is more stable than $AlB_2$. The process of the present invention not only avoids the $AlB_2$ to $TiB_2$ transformation, but also offers exceptional microstructural features. $Al_3Ti$ particles generated by a solid state reaction between $K_2TiF_6$ and aluminium are much smaller than those available in Al—Ti/Al—Ti—B master alloys prepared with prior art yielding a superior grain refining performance.

The present invention offers a process for the production of Al—Ti—B grain refiner master alloys, containing from 1 to 10% titanium, 0.2 to 3% boron and the balance essentially aluminum, wherein the resultant alloy contains $Al_3Ti$ particles having a diameter of less than 20 microns and a fine dispersion of $AlB_2$ particles. The process of the present invention also relies on the reaction of halide salts with aluminum to produce Al—Ti—B grain refiner master alloy, yet is different from the prior art as it is a powder metallurgy process and takes place in the solid state. The present invention yields smaller $Al_3Ti$ particles which ensure a fast grain refining response and $AlB_2$, instead of $TiB_2$ particles. The Al—Ti—B grain refiner alloys produced according to the present invention provided consistent and better overall grain refining performance with respect to those prepared with the prior art.

A sound process to produce a Al—Ti—B master alloys which ensure an adequate grain refining performance for aluminium foundry alloys is claimed to comprise the following steps: Mixing Al—B alloy powder and $K_2TiF_6$ salt thoroughly to obtain a blended mixture; heating the mixed powder blend thus obtained under flowing argon to slightly below the melting point of aluminium, i.e. 650 degrees Celcius, and holding it at this temperature sufficiently long, i.e. for ½ hours. Inoculation with the said alloys has produced a fine equiaxed grain structure across the entire section of the test sample which was more or less retained for 15 minutes after inoculation. Besides, the dendritic as-cast structure is improved into a more homogeneous one, dominated by equiaxed a —Al rosettes.

Advantageous Effects

1. The process of the present invention also relies on the reaction of halide salts with aluminum to produce Al—Ti—B grain refiner master alloy, yet is different from the prior art as it is a powder metallurgy process and takes place in the solid state. The process of the present invention not only avoids the $AlB_2$ to $TiB_2$ transformation, but also offers exceptional microstructural features. $Al_a$ Ti particles generated by a solid state reaction between $K_2TiF_6$ and aluminium are much smaller than those available in Al—Ti—B master alloys prepared with prior art. The resultant alloys contains soluble $Al_3Ti$ particles having a diameter of less than 20 microns and thus ensure a fast grain refining response. The insoluble particles in the Al—Ti—B grain refining master aloys produced with the present invention additionally are of the $AlB_2$ variety, instead of $TiB_2$. The former are known to be much more effective in aluminium foundry alloys with high silicon levels. The Al—Ti—B grain refiner alloys produced according to the present invention provide consistent and better overall grain refining performance with respect to those prepared with the prior art.

In accordance with one aspect of the present invention, a method to produce Al—Ti—B grain refiner master alloys with $Al_3Ti$ particles and $AlB_2$ particles dispersed in an aluminium matrix is provided. The method includes thoroughly mixing Al—B alloy powder and $K_2TiF_6$ salt to obtain a blended mixture, heating the mixed powder blend under flowing argon to between 600 Centigrade and 650 Centigrade, holding the mixed powder blend at this temperature for ½ hours, and pressing the heat treated powder blend into pellets.

The boron content of the Al—B alloy may be between 1 to 10 wt %.

The Al—B alloy powder of the present method may be prepared by adding $KBF_4$ salt into molten aluminium to facilitate a salt reaction to form the $AlB_2$ particles dispersed in an aluminium matrix, and pulverizing the alloy thus produced into powder form.

The titanium to boron ratio by weight of the resultant alloy of the present invention may be equal to or less than 1 and the titanium and boron contents are between 1 to 5% Ti and 1 to 5% B, respectively, the balance being aluminium, potassium and fluorine. The resultant alloy may contains $Al_3Ti$ particles smaller than 20 microns.

BEST MODE

Al—3B alloy powder and $K_2TiF_6$ salt is thoroughly mixed to obtain a blended mixture. The former is produced by reacting $KBF_4$ salt with molten aluminium at 800° C. The ratio of individual components in the mixture are adjusted so as to obtain 3 wt % Ti and 3 wt % B in the final alloy. The fraction of aluminium retained in the spent salt as K—Al fluorides after the synthesis process is compensated for with commercial purity aluminium. Sample taken from the mixed powder blend thus obtained was heated in a tube furnace under flowing argon to 650 Centigrade, and held at this temperature for ½ hours. The heat treated samples were shown with X-Ray Diffraction (XRD) and metallographic techniques, to comprise $Al_3Ti$, $AlB_2$ particles dispersed in an aluminium matrix.

Figure 1:
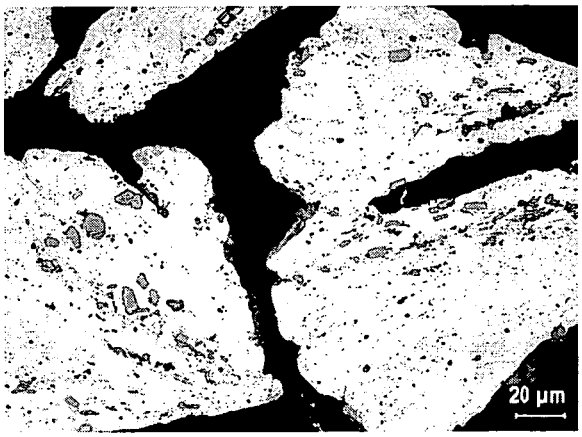
FIG. 1 shows the Al—3Ti—3B alloy tablet produced in accordance with the present invention.
Figure 2:
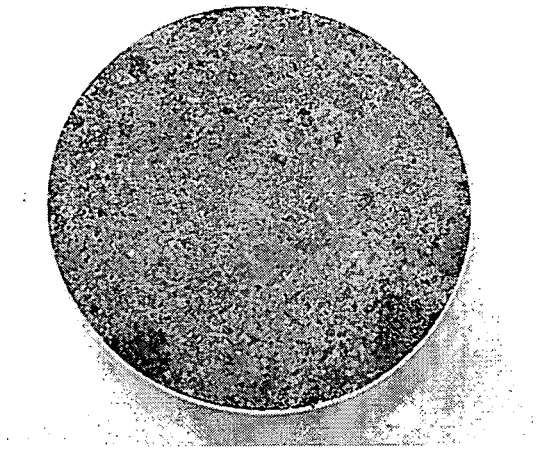
FIG. 2 shows the optical micrograph of the resulting Al—3Ti—3B alloy tablet produced in accordance with the present invention.
Figure 3:
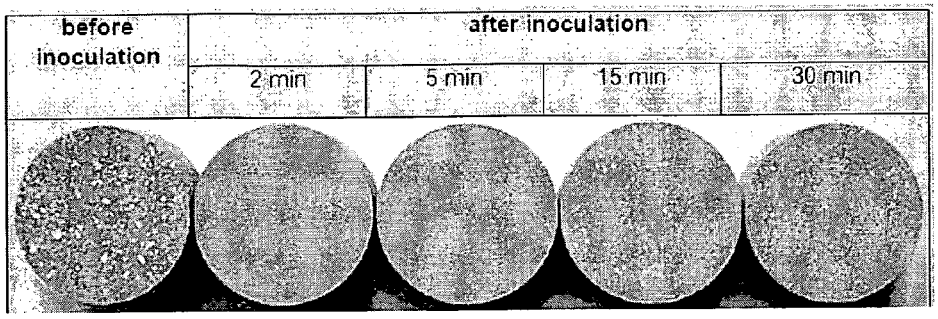
FIG. 3 shows the grain refinement performance test results after inoculation with the resulting Al—3Ti—3B alloy tablet produced in accordance with the present invention.
Figure 4:
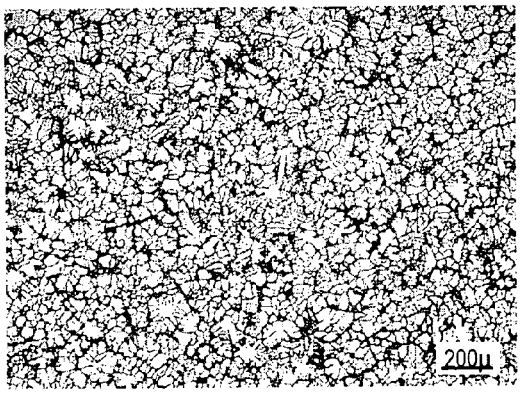
FIG. 4 shows the microstructure of an Al-7 wt % Si foundry alloy after inoculation with the resulting Al—3Ti—3B alloy tablet produced in accordance with the present invention.

The Al—3Ti—3B pellet (FIG. 1) produced so as to contain both $Al_3Ti$ and $AlB_2$ particles (FIG. 2) is a fast acting effective grain refiner for the Al—7 wt % Si alloy. Inoculation with the present alloy has produced a fine equiaxed grain structure across the entire section of the test sample which was more or less retained for 15 minutes after inoculation (FIG. 3). The performance of this alloy is clearly superior than that of the binary Al—3B alloy confirming the favorable impact of $Al_3Ti$ on grain refinement of hypoeutectic Al—Si foundry alloys. Besides, the dendritic as-cast structure was improved into a more homogeneous one, dominated by equiaxed a —Al rosettes (FIG. 4). The present alloy can be used effectively when and where the grain refiner additions are made shortly before casting.

The invention claimed is:

1. A method to produce Al—Ti—B grain refiner master alloys with $Al_3Ti$ particles and $AlB_2$ particles dispersed in an aluminium matrix, comprising;

a. thoroughly mixing Al—B alloy powder and $K_2TiF_6$ salt to obtain a blended mixture, b. heating the mixed powder blend under flowing argon to between 600 Centigrade and 650 Centigrade, c. holding the mixed powder blend at this temperature for ½ hours, d. pressing the heat treated powder blend into pellets.

2. A method according to claim 1, wherein the boron content of the Al—B alloy is between 1 to 10 wt %.

3. A method according to claim 1, wherein the Al—B alloy powder is prepared by a. adding $KBF_4$ salt into molten aluminium to facilitate a salt reaction to form the $AlB_2$ particles dispersed in an aluminium matrix, b. pulverizing the alloy thus produced into powder form.

4. A method according to claim 1, wherein the titanium to boron ratio by weight of the resultant alloy is equal to or less than 1 and the titanium and boron contents are between 1 to 5% Ti and 1 to 5% B, respectively, the balance being aluminium, potassium and fluorine.

5. A method according to claim 1, wherein the resultant alloy contains $Al_3Ti$ particles smaller than 20 microns.

* * * * *